United States Patent [19]

Emmenthal

[11] Patent Number: 4,646,706

[45] Date of Patent: Mar. 3, 1987

[54] SYSTEM FOR CONTINUOUS FUEL INJECTION

[75] Inventor: Klaus-Dieter Emmenthal, Wolfsburg, Fed. Rep. of Germany

[73] Assignee: Volkswagenwerk Aktiengesellschaft, Wolfsburg, Fed. Rep. of Germany

[21] Appl. No.: 613,100

[22] Filed: May 23, 1984

[30] Foreign Application Priority Data

May 28, 1983 [DE] Fed. Rep. of Germany ..... 3319494

[51] Int. Cl.[4] ..... F02M 39/00

[52] U.S. Cl. ..... 123/585; 123/463; 123/459; 123/452

[58] Field of Search ..... 123/459, 463, 585, 458, 123/506, 447, 446, 500, 501, 452, 453; 239/585, 88–95

[56] References Cited

U.S. PATENT DOCUMENTS

| | | | |
|---|---|---|---|
| 4,050,431 | 9/1977 | Jackson | 123/463 |
| 4,235,205 | 11/1980 | Fukui | 123/463 |
| 4,387,695 | 6/1983 | Hoppel | 123/585 |
| 4,429,674 | 2/1984 | Lubbing | 123/585 |

FOREIGN PATENT DOCUMENTS

| | | | |
|---|---|---|---|
| 2757248 | 6/1979 | Fed. Rep. of Germany | 123/452 |
| 2900691 | 7/1980 | Fed. Rep. of Germany | 123/452 |
| 2920636 | 9/1983 | Fed. Rep. of Germany | 123/452 |
| 3024971 | 4/1984 | Fed. Rep. of Germany | 123/452 |

*Primary Examiner*—Carl Stuart Miller

*Attorney, Agent, or Firm*—Brumbaugh, Graves, Donohue & Raymond

[57] ABSTRACT

In the representative system for continuous fuel injection described in the specification, an air pump withdraws air from the air intake line of a gasoline engine and a fuel pump delivers fuel from a fuel tank through a fuel pressure regulator to a metering device which supplies fuel as a function of the operating state of the internal combustion engine, the air withdrawn from the intake line being mixed with the fuel from the metering device. The fuel pressure regulator returns excess fuel to the fuel tank through a return line and, in order provide fast response to sudden load changes, a valve device, which can be adjusted as a function of the variations in the rate of application of the load on the internal combustion engine, is provided in the return line. The valve device is controlled according to changes in the vacuum in the intake line downstream from a butterfly valve.

5 Claims, 1 Drawing Figure

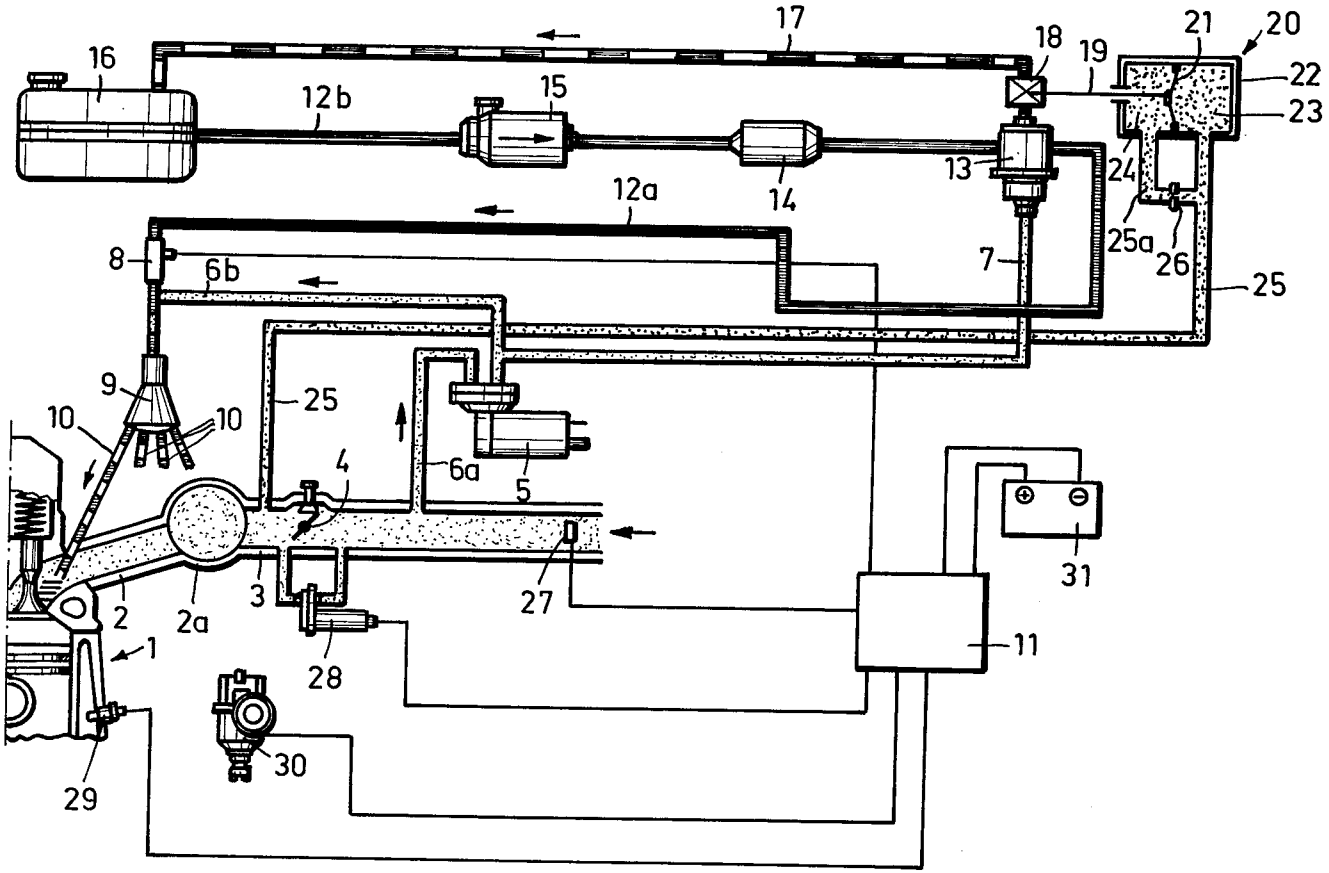
20
22
23
21
25
26
24
25a
19
18
13
7
17
14
12a
15
12b
16
8
6b
9
10
10
25
4
5
6a
27
28
3
2a
2
1
29
30
31
11

SYSTEM FOR CONTINUOUS FUEL INJECTION

BACKGROUND OF THE INVENTION

This invention relates to systems for continuous fuel injection into the intake line of an internal combustion engine and, more particularly, to a new and improved continuous fuel injection system providing better acceleration response.

In certain conventional fuel injection systems as described, for example, in DE-OS No. 29 00 691 and DE-OS No. 29 00 636, some air is withdrawn from the air intake line and mixed with the fuel which is supplied by a metering device as a function of the operating state of the internal combustion engine. The withdrawal of air and the metering of fuel are effected independently of each other and the fuel and air are combined into a fuel-air mixture just ahead of the distributor which supplies the mixture to the individual cylinders of the internal combustion engine. With this arrangement, a mixture of air and fuel is delivered through the injection points into the intake manifold pipes of the internal combustion engine in a constant manner. Even with a full load on the internal combustion engine, the fuel-air mixture is properly prepared before it is injected. Moreover, because the fuel is injected into the withdrawn air just before the fuel-air mixture is supplied to the manifold close to the engine, there is a substantial reduction in the response time of the fuel injection device when the operating state of the internal combustion engine changes. It has been found that such systems work satisfactorily. In spite of the relatively short response time of fuel injection systems which are electronically operated, however, difficulties arise at times, especially when the internal combustion engine is accelerated abruptly from low partial-load ranges. At such sudden load increases on the internal combustion engine, the fuel quantity apportioned by the metering device frequently is not sufficient to produce the desired acceleration of the internal combustion engine.

Therefore, it is an object of this invention to provide an improved fuel injection system of a simple and inexpensive construction wherein a sufficient fuel supply is ensured, even when there are sudden load increases, without requiring special acceleration enrichment arrangements.

SUMMARY OF THE INVENTION

In accordance with the invention a fuel injection system is provided with a valve device in the fuel return line from the fuel pressure regulator, the valve device being adjustable in response to variations in the load on the internal combustion engine. With this arrangement, the fuel pressure in the fuel line leading to the fuel metering device can be increased by throttling the flow of fuel delivered through the fuel pressure regulator. The increased pressure in the fuel return line produces an adjustment of the equilibrium in the fuel pressure regulator controlling the fuel supply pressure.

BRIEF DESCRIPTION OF THE DRAWING

The accompanying drawing is a schematic circuit diagram illustrating a representative embodiment of a fuel injection system in accordance with the invention.

DESCRIPTION OF A PREFERRED EMBODIMENT

In the typical example of the invention illustrated in the accompanying drawing, a conventional mixture-compressing Otto internal combustion engine 1 has an intake pipe 2 leading to each of the individual cylinders of the engine from an intake distributor **2*a* which is connected to an air intake line 3. The air intake line 3 has a conventional butterfly valve 4**, actuated in the usual way by an adjustable accelerator pedal (not shown), producing a partial vacuum downstream of the valve which varies as a function of the engine load.

An air pump 5, which is connected to the intake line 3 upstream of the butterfly valve 4 by an air line **6*a*, removes part of the air flowing through the intake line 3 and delivers it through an air line 6*b* to a fuel metering point where the flow of fuel is adjusted to the prevailing operating condition of the internal combustion engine by a fuel metering valve 8. The fuel-air mixture thus formed under pressure is thereafter uniformly distributed by a distributor 9 to a series of fuel injection lines 10, each associated with one of the individual cylinders of the internal combustion engine 1, which open into the intake pipes 2** of the individual cylinders just upstream of the corresponding intake valves.

The advantage of fuel injection systems of this type is that no injection nozzles, such as are provided in conventional fuel injection systems, are required for injection of the fuel-air mixture under pressure into the intake pipes. This is because the mixture under pressure will expand on entry into the intake pipe, even if the pressure is low, and will thereby be finely divided and sprayed. During expansion of the mixture, at least a partial evaporation of the liquid fuel contained in the fuel-air mixture also occurs so that the preparation of the fuel for combustion is further improved.

A fuel pump 15 withdraws the fuel from a tank 16 through a filter 14 and a fuel pressure regulator 13 and passes it to the fuel metering valve 8 by way of a fuel line **12*a*. The pressure regulator 13 is connected by an air line 7 to the air line 6*b* and is arranged to return fuel not required for engine operation to the fuel tank 16 by a return line 17. A control device 11 controls the fuel metering device 8 so that it provides fuel in accordance with the prevailing operating state of the internal combustion engine. For this purpose, the control device 11, which is energized by a battery 31, receives information from an air flow meter 27, arranged in the intake line 3, as well as from a temperature sensor 29 which detects the cooling water temperature in the engine block of the internal combustion engine 1. The control device 11 controls not only the fuel metering valve 8, but also an auxiliary air slide valve 28, which is arranged in a line bypassing the butterfly valve 4, as well as an ignition distributor 30**.

In order to provide a sufficient fuel quantity to the cylinders when sudden changes in the load on the internal combustion engine 1 occur, especially for acceleration out of the partial load range, the invention provides for an increase in the fuel pressure in the fuel line **12*a* to the fuel metering valve 8 during such operating conditions. This is obtained by providing a valve device 18, which may be an adjustable throttle, in the fuel return line 17 just beyond the fuel pressure regulator 13. By operation of the valve device 18, the pressure in the fuel return line 17 can be varied and, in particular, can be increased. Such a pressure increase modifies the pressure equilibrium in the fuel pressure regulator 13 so that the fuel delivery pressure in the fuel delivery line 12***a* is increased. With such increased pressure in the fuel line 12*a*, the fuel flow rate through the fuel metering valve 8 is increased without any change in the setting of the metering valve, thereby causing an enrichment of the fuel-air mixture and resulting in an acceleration of the internal combustion engine 1.

In the particular embodiment shown in the drawing, control of the valve device 18 is provided by a pneumatic control device 20. The control device 20 has a control cylinder 22 with an axially displaceable diaphragm piston 21 connected to the valve device 18 by an actuating rod 19. A spring, not shown, may be provided in order to urge the control device 20 toward a set starting position in which the fuel return line 17 is fully opened.

The diaphragm piston 21 divides the interior space of the cylinder 22 into two pressure chambers 23 and 24, the pressure chamber 23 being connected through a line 25 directly with a point in the intake line 3 downstream of the butterfly valve 4 where there is a vacuum which is a function of the position of the butterfly valve. The other pressure chamber 24 is connected with the line 25 through a branch line 25*a* having a fixed throttle 26. As a result, when there is a rapid variation in the intake pipe pressure, the pressure adjustment in the chamber 24 is delayed, causing the diaphragm piston 21 to adjust the valve device 18 by motion of the actuating rod 19.

If the operator of a vehicle equipped with an injection system of the type described herein depresses the accelerator pedal quickly to move it from a low partial load position in order to accelerate the vehicle, the resulting sudden opening of the butterfly valve 4 causes a sudden decrease in the vacuum in the intake line 3 and in the intake pipes 2. This is transmitted through the line 25 to the pressure chamber 23 but, because the change in pressure is delayed in being transmitted to the pressure chamber 24 by the throttle 26, there is initially a higher vacuum in the chamber 24. The pressure difference causes a displacement of the diaphragm piston 21 to the left as shown in the drawing so that the valve device 18, or alternatively, an adjustable throttle, is moved to block the fuel return line 17.

Such throttling of the return line produces an increase in the fuel pressure in the fuel pressure regulator 13 which is transmitted through the fuel delivery line 12*a* to the fuel metering valve 8. As a result, although the position of the fuel metering valve 8 is unchanged, more fuel is supplied to the air from the line 6*b* which is then injected by way of the injection lines 10 into the combustion chambers of the internal combustion engine 1. The throttling of the fuel return line 17 occurs, however, only as long as the pressure in the pressure chamber 24 of the pneumatic control device 20 is below the pressure in the pressure chamber 23. As soon as pressure equalization in the chambers 23 and 24 of the control device 20 has been attained, the actuation rod 19 is restored to its normal position by means of the spring, not shown, so that the fuel return line 17 is fully opened and the normal fuel pressure is restored to the fuel line 12*a* by the fuel pressure regulator 13. In this condition, the usual fuel quantities are again injected without the acceleration enrichment.

For sudden decreases in load on the engine, the system of the invention is inoperative since, in such cases, the fuel quantity to be delivered by the fuel metering device 8 can be reduced by the control device 11 with sufficient speed, if necessary, even to zero.

Although the invention has been described herein with reference to a specific embodiment, many modifications and variations therein will readily occur to those skilled in the art. For example, the valve device 18 in the fuel return line 17 could also be controlled as a function of the rate of change in the load on the internal combustion engine in order to increase the pressure of the fuel supplied to the metering valve 8. Accordingly, all such variations and modifications are included within the intended scope of the invention as defined by the following claims.

I claim:

1. A fuel injection system for continuous fuel injection into the intake line of a gasoline internal combustion engine comprising an air intake line to supply air to the engine, pump means for withdrawing air from the intake line, a fuel tank, a metering device for supplying fuel to the air withdrawn from the intake line as a function of the operating state of the internal combustion engine, a fuel pump for delivering fuel under pressure from the fuel tank through a fuel line to the metering device, a fuel pressure regulator for regulating fuel pressure in the fuel line in dependence on air pressure delivered by the air pump means and returning excess fuel to the fuel tank through a return line, and valve means in the return line operable independently of the fuel pressure regulator in response to the rate of variation in the load on the internal combustion engine for additionally adjusting said fuel pressure regulator by throttling the fuel return flow through the return line to cause sufficient fuel to be delivered through the fuel line to the metering device to enable the engine to accelerate in response to said rate of variation in load.

2. A fuel injection system according to claim 1 wherein the air intake line has a butterfly valve and the valve means can be adjusted as a function of the variation in rate of change of the vacuum in the intake line downstream from the butterfly valve.

3. A fuel injection system according to claim 2 including pneumatic control means responsive to variation in the intake line pressure for controlling the operation of the valve means.

4. A fuel injection system according to claim 3 wherein the pneumatic control means comprises a cylinder divided into two chambers by a displaceable member, one chamber being connected directly to the intake line deownstream from the butterfly valve and the other chamber being connected through a throttle element to the intake line downstream of the butterfly valve.

5. A fuel injection system according to claim 4 wherein the displaceable member comprises a diaphragm mounted in the cylinder.

* * * * *